US011749953B2

(12) United States Patent
Murata et al.

(10) Patent No.: US 11,749,953 B2
(45) Date of Patent: Sep. 5, 2023

(54) CONNECTOR STRUCTURE

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Atsushi Murata, Mie (JP); Junichi Ono, Mie (JP); Kazuaki Hamada, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 141 days.

(21) Appl. No.: 17/312,914

(22) PCT Filed: Dec. 5, 2019

(86) PCT No.: PCT/JP2019/047581
§ 371 (c)(1),
(2) Date: Jun. 10, 2021

(87) PCT Pub. No.: WO2020/129665
PCT Pub. Date: Jun. 25, 2020

(65) Prior Publication Data

US 2022/0069528 A1 Mar. 3, 2022

(30) Foreign Application Priority Data

Dec. 21, 2018 (JP) ..... 2018-239932

(51) Int. Cl.
*H01R 13/655* (2006.01)
*H01R 13/6592* (2011.01)
(Continued)

(52) U.S. Cl.
CPC ..... *H01R 13/6592* (2013.01); *H01R 4/184* (2013.01); *H01R 4/20* (2013.01); *H01R 13/6473* (2013.01); *H01R 13/6582* (2013.01)

(58) Field of Classification Search
CPC ..... H01R 13/6592; H01R 13/6581; H01R 13/6481; H01R 13/6482; H01R 13/6461;
(Continued)

(56) References Cited

U.S. PATENT DOCUMENTS 4,611,878 A * 9/1986 Hall ..... H01R 13/6593 439/353
5,180,316 A * 1/1993 Miller ..... H01R 13/6592 439/247

(Continued)

FOREIGN PATENT DOCUMENTS

JP H02-069484 U 5/1990

*Primary Examiner* — Harshad C Patel
(74) *Attorney, Agent, or Firm* — Venjuris, P.C.

(57) ABSTRACT

A female connector structure is provided with a shielded cable configured such that an outer periphery of a coated wire including a core and an insulation coating is surrounded by a braided wire, a female terminal including a wire barrel and a connecting tube portion and to be connected to a mating terminal, an insulating dielectric for surrounding an outer periphery of the connecting tube portion, and an outer conductor including a shield connecting portion, the outer conductor surrounding at least the coated wire. A part of the outer conductor corresponding to the coated wire exposed from the braided wire is formed with a projecting portion by causing a part of an inner surface of the outer conductor to project from other parts radially inwardly of the outer
(Continued)

conductor, and an outer surface of the outer conductor is not depressed radially inwardly of the outer conductor.

6 Claims, 13 Drawing Sheets

(51) Int. Cl.
*H01R 4/18* (2006.01)
*H01R 4/20* (2006.01)
*H01R 13/6473* (2011.01)
*H01R 13/6582* (2011.01)

(58) Field of Classification Search
CPC ..... H01R 4/184; H01R 4/185; H01R 4/183; H01R 4/18; H01R 4/20
USPC ..... 439/607.41
See application file for complete search history.

(56) References Cited

U.S. PATENT DOCUMENTS 6,384,335 B1 * 5/2002 Saito ..... H01R 9/0518 439/585
7,160,150 B2 * 1/2007 Annequin ..... H01R 43/048 439/585
7,422,480 B1 * 9/2008 Musick ..... H01R 9/0518 439/879
7,632,144 B2 * 12/2009 Sakaguchi ..... H01R 9/0518 439/585
7,635,282 B2 * 12/2009 Sakamoto ..... H01R 9/0518 439/585
7,989,647 B2 * 8/2011 Geiger ..... C11C 3/006 554/183
8,052,166 B2 * 11/2011 Noble ..... F16F 1/44 280/681
8,052,466 B2 * 11/2011 Okamoto ..... H01R 9/0518 439/585
8,414,329 B2 * 4/2013 Morikawa ..... H01R 4/185 439/585
8,974,258 B2 * 3/2015 Mitose ..... H01R 4/70 439/877
8,991,045 B2 * 3/2015 Poma ..... H01R 9/0518 29/862
9,153,878 B2 * 10/2015 Poma ..... H01R 4/10
9,647,352 B2 * 5/2017 Sato ..... H01R 4/185
9,799,976 B2 * 10/2017 Lehner ..... H01R 13/04
9,972,932 B2 * 5/2018 Copper ..... H01R 13/113
10,367,311 B2 7/2019 Zebhauser et al.
10,992,087 B2 * 4/2021 Hoyack ..... H01R 4/2495
2011/0318960 A1 * 12/2011 Koga ..... H01R 9/05 439/585
2012/0252265 A1 10/2012 Wild et al.
2013/0171873 A1 * 7/2013 Kanda ..... H01R 24/44 439/607.51
2014/0322995 A1 * 10/2014 Frimmersdorf ..... H01R 4/28 29/874

* cited by examiner

CONNECTOR STRUCTURE

CROSS REFERENCE TO RELATED APPLICATIONS

This application is a national phase of PCT application No. PCT/JP2019/047581, filed on 5 Dec. 2019, which claims priority from Japanese patent application No. 2018-239932, filed on 21 Dec. 2018, all of which are incorporated herein by reference.

TECHNICAL FIELD

A technique disclosed in this specification relates to a connector structure formed by connecting a connector to a shielded cable.

BACKGROUND

Conventionally, a connector structure is known from Japanese Patent Laid-Open Publication No. 2018-505528. This connector structure includes a shielded cable in which a core, an insulation coating, a shield portion and a sheath are laminated from inside to outside, an inner conductor to be connected to the core, an insulating dielectric for surrounding the outer periphery of the inner conductor and an outer conductor for surrounding a coated wire and the dielectric. The coated wire exposed from a sheath of the coated wire and the shield portion is electromagnetically shielded by being surrounded by the outer conductor.

In the above connector structure, a part of the outer conductor corresponding to the coated wire exposed from the shield portion is drawn inwardly in a radial direction of the outer conductor. In this way, a difference between a distance between the coated wire and the shield portion and a distance between the coated wire and the outer conductor can be reduced, wherefore a change of a characteristic impedance of the coated wire is suppressed.

PRIOR ART DOCUMENT

Patent Document

Patent Document 1: JP 2018-505528 A

SUMMARY OF THE INVENTION

Problems to be Solved

However, according to the above technique, since the outer conductor is drawn, a processing distortion occurs in the outer conductor. If this processing distortion becomes excessively large, troubles such as the formation of cracks in the outer conductor may occur.

The setting of a long front-rear length of a part of the outer conductor to be drawn in order to suppress the processing distortion of the outer conductor is not preferable since the connector structure is enlarged.

The technique disclosed in this specification was completed on the basis of the above situation and aims to provide a connector structure having a change of a characteristic impedance suppressed while suppressing enlargement.

Means to Solve the Problem

The technique disclosed in this specification is directed to a connector structure with a shielded cable configured such that an outer periphery of a coated wire including a core and an insulation coating surrounding an outer periphery of the core is surrounded by a shield portion, an inner conductor including a core connecting portion to be connected to the core and a connecting portion continuous with the core connecting portion and to be connected to a mating terminal, an insulating dielectric for surrounding at least an outer periphery of the connecting portion of the inner conductor, and an outer conductor including a shield connecting portion to be electrically connected to the shield portion, the outer conductor surrounding at least the coated wire exposed from the shield portion, a part of the outer conductor corresponding to the coated wire exposed from the shield portion being formed with a projecting portion by causing a part of an inner surface of the outer conductor to project from other parts radially inwardly of the outer conductor and an outer surface of the outer conductor being not depressed radially inwardly of the outer conductor.

According to the above configuration, the inner surface of the outer conductor can be brought closer to the coated wire without drawing the outer conductor. In this way, a change of a characteristic impedance of the coated wire can be suppressed without enlarging the outer conductor.

The following modes are preferable as embodiments of the technique disclosed in this specification.

The projecting portion projects from an end edge of the outer conductor and is formed by being folded to overlap on the inner surface of the outer conductor.

According to the above configuration, since the inner surface of the outer conductor can be brought closer to the coated wire by a simple processing method of folding the projecting portion, the manufacturing cost of the connector structure can be reduced.

The outer conductor includes a rear outer conductor having a shield connecting portion to be crimped to the shield portion from outside, a dielectric crimping portion to be crimped to at least a part of the dielectric from outside and a rear tube portion for surrounding the coated wire between the shield connecting portion and the dielectric crimping portion, and a front outer conductor having a front tube portion for surrounding the dielectric and a rear outer conductor crimping portion to be crimped to the dielectric crimping portion from outside, and the rear tube portion is formed with the projecting portion.

According to the above configuration, since the rear and front outer conductors can be connected without being heated, the occurrence of troubles in the dielectric due to heat can be suppressed.

The outer conductor includes a front outer conductor having a front tube portion for surrounding the dielectric and a dielectric locking portion to be locked to at least a part of the dielectric, and a rear outer conductor having a shield connecting portion to be crimped to the shield portion from outside, a front outer conductor crimping portion to be crimped to at least the dielectric locking portion from outside and a rear tube portion for surrounding the coated wire between the shield connecting portion and the front outer conductor crimping portion, and the rear tube portion is formed with the projecting portion.

According to the above configuration, since the rear and front outer conductors can be connected without being heated, the occurrence of troubles in the dielectric due to heat can be suppressed.

Effect of the Invention

According to the technique disclosed in this specification, a change of a characteristic impedance can be suppressed for a connector structure without enlarging an outer conductor.

DETAILED DESCRIPTION TO EXECUTE THE INVENTION

First Embodiment

Figure 1:
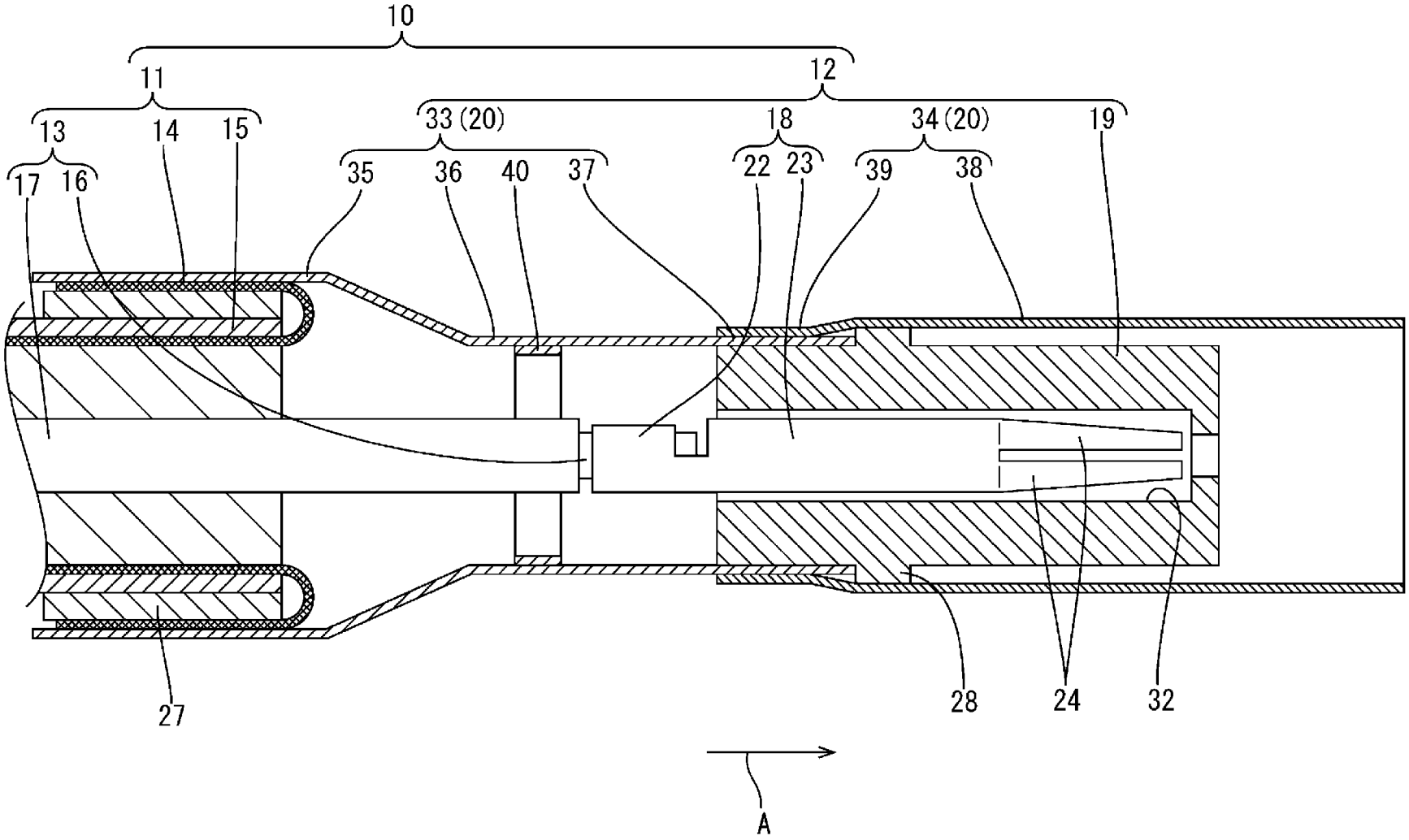
FIG. 1 is a section showing a female connector structure according to a first embodiment.

A first embodiment of the technique disclosed in this specification is described with reference to FIGS. 1 to 10. A female connector structure 10 according to this embodiment is formed by connecting a female connector 12 to an end of a shielded cable 11. The female connector 12 includes female terminals 18 (example of an inner conductor), a dielectric 19, a rear outer conductor 33 and a front outer conductor 34. In the following description, an extending direction (direction indicated by an arrow A) of the shielded cable 11 is referred to as a forward direction. Further, only some of a plurality of identical members may be denoted by a reference sign and the other members may not be denoted by the reference sign.

[Shielded Cable 11]

Figure 7:
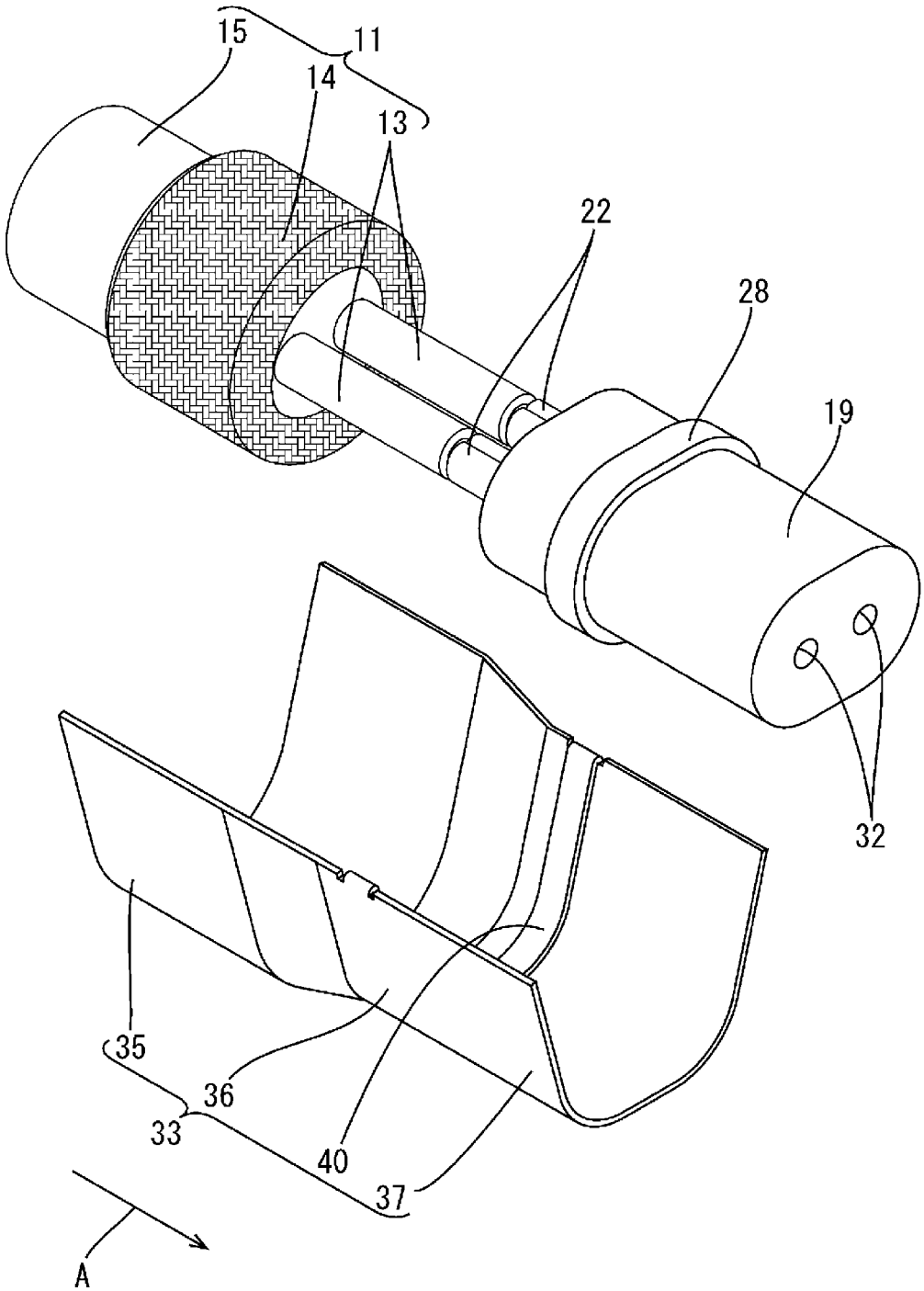
FIG. 7 is a perspective view showing a step of crimping a rear outer conductor having folded projecting portions to the braided wire and the dielectric.

As shown in FIG. 7, the shielded cable 11 is configured such that the outer peripheries of a plurality of (two in this embodiment) coated wires 13 are surrounded by a braided wire 14 (example of a shield portion) made of metal thin wires and the outer periphery of the braided wire 14 is surrounded by a sheath 15 made of an insulating material. Each coated wire 13 includes a core 16 and an insulation coating 17 surrounding the outer periphery of the core 16. An arbitrary metal such as copper, copper alloy, aluminum or aluminum alloy can be selected as a metal constituting the core 16 according to need. The core 16 may be formed by one metal strand or may be formed by a stranded wire formed by twisting a plurality of metal strands. The insulation coatings 17 and the sheath 15 are made of insulating synthetic resin.

An end processing such stripping is applied to an end of the shielded cable 11 to expose an end of each of the cores 16, the insulation coatings 17 and the braided wire 14.

[Female Connector 12]

The female connector 12 includes the female terminals 18 (example of the inner conductor), the insulating dielectric 19 for surrounding the outer peripheries of the female terminals 18 and an outer conductor 20 for surrounding the outer periphery of the dielectric 19. The outer conductor 20 includes the rear outer conductor 33 and the front outer conductor 34 electrically connected to a front end part of the rear outer conductor 33.

[Female Terminals 18]

Figure 5:
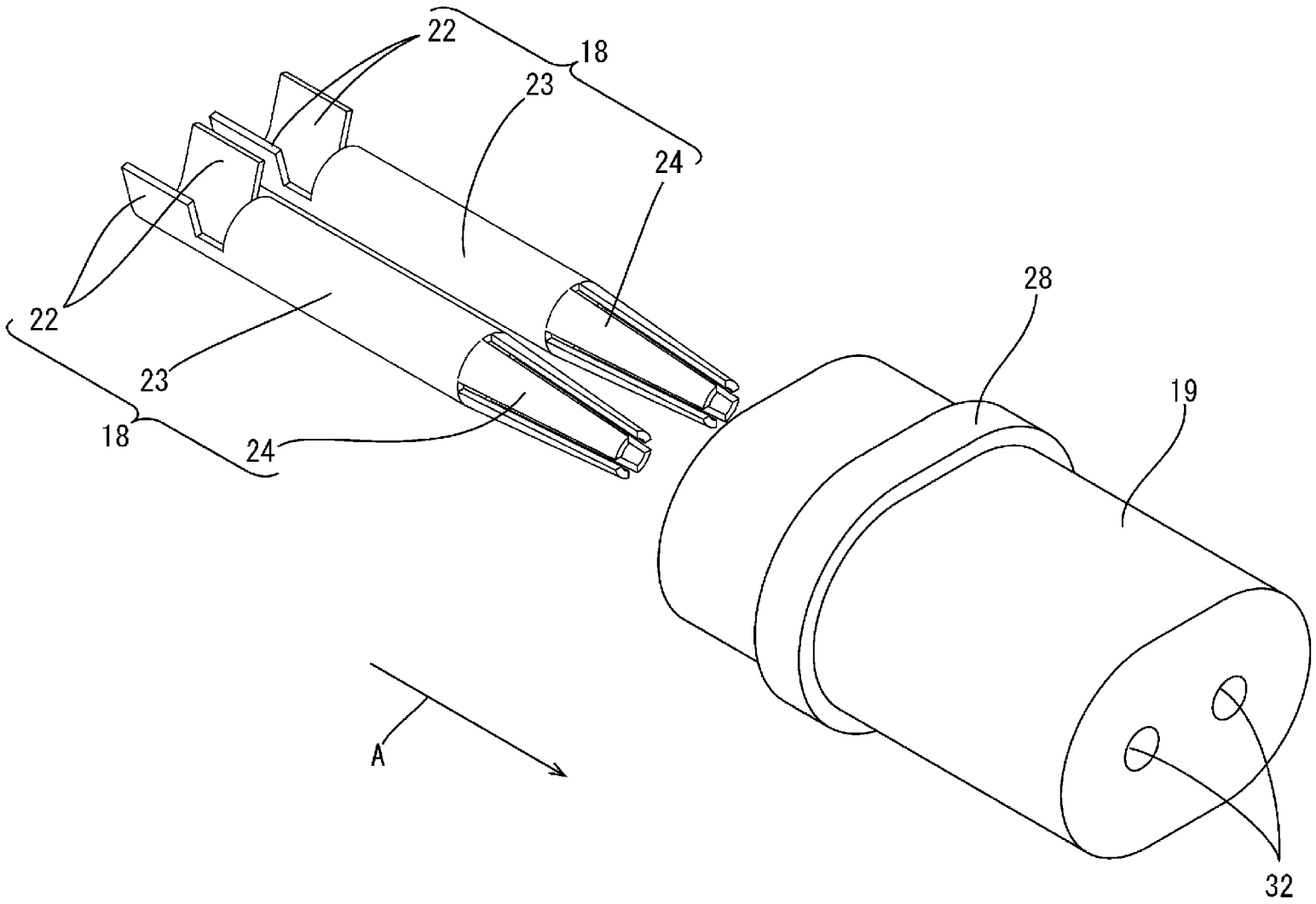
FIG. 5 is a perspective view showing a step of inserting female terminals into a dielectric.

As shown in FIG. 5, the female terminal 18 is formed by press-working a metal plate material into a predetermined shape. An arbitrary metal such as copper, copper alloy, aluminum or aluminum alloy can be selected as a metal constituting the female terminal 18 according to need. The female terminal 18 is connected to the end of each coated wire 13. The female terminal 18 includes a wire barrel 22 (example of a core connecting portion) to be crimped to wind around the outer periphery of the core 16 and a connecting tube portion 23 (example of a connecting portion) connected in front of the wire barrel 22, an unillustrated mating terminal being inserted into the connecting tube portion 23.

The connecting tube portion 23 is formed with a plurality of slits extending rearward from a front end part of the connecting tube portion 23, thereby providing a plurality of resilient contact pieces 24 extending in a front-rear direction. The plurality of resilient contact pieces 24 are reduced in diameter toward a front side and formed to be resiliently deformable in a radial direction of the connecting tube portion 23. By inserting the mating terminal into the connecting tube portion 23, the mating terminal and the resilient contact pieces 24 resiliently contact, whereby the mating terminal and the female terminal 18 are electrically connected.

[Braided Wire 14]

The braided wire 14 is formed by braiding a plurality of metal thin wires into a tube. A part of the braided wire 14 exposed from the end of the sheath 15 is folded toward an end of the sheath 15 and overlapped on the outside of a sleeve 27 described below.

[Sleeve 27]

The annular sleeve 27 is externally fit to the outside of the end of the sheath 15. As described above, the braided wire 14 is overlapped on the outside of the sleeve 27. The sleeve 27 according to this embodiment is formed into a substantially annular shape by crimping an elongated metal plate material to wind around the outer periphery of the sheath 15.

[Dielectric 19]

Figure 6:
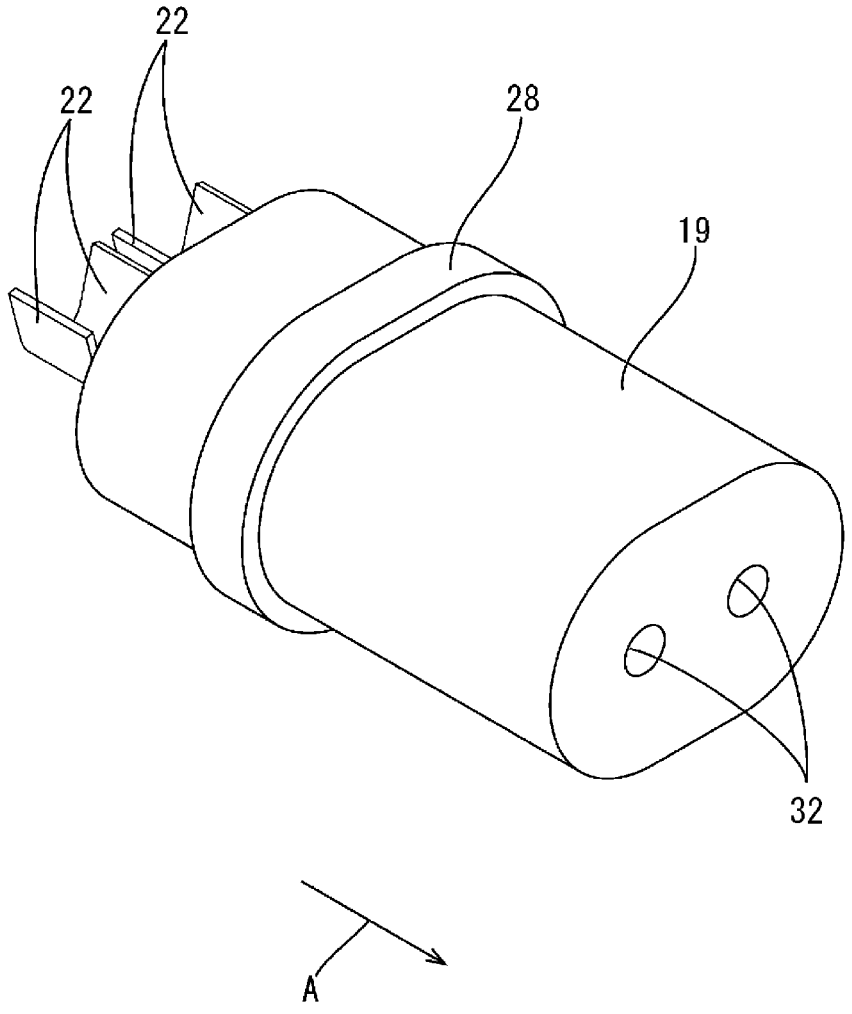
FIG. 6 is a perspective view showing a state where the female terminals are inserted in the dielectric.

As shown in FIG. 1, the connecting tube portion 23 of the female terminal 18 is surrounded around by the dielectric 19. The dielectric 19 is formed by injection molding using an insulating synthetic resin. The wire barrel 22 projects rearward from a rear end part of the dielectric 19. As shown in FIGS. 5 and 6, the dielectric 19 extends in the front-rear direction as a whole and has an oval cross-sectional shape elongated in a lateral direction.

The dielectric 19 is formed with a plurality of (two in this embodiment) cavities 32 which are arranged side by side in the lateral direction and open in the front-rear direction and into which the connecting tube portions 23 of the female terminals 18 are respectively accommodated. The mating terminal is inserted through a front opening of the cavity 32. The wire barrel 22 is drawn out rearward as described above through a rear opening of the cavity 32.

A flange 28 projecting radially outwardly of the dielectric 19 is formed on substantially one-third part of the dielectric 19 from the rear end part in the front-rear direction.

[Rear Outer Conductor 33]

As shown in FIGS. 1 and 7, the rear outer conductor 33 is formed by press-working a metal plate material into a predetermined shape. An arbitrary metal such as copper, copper alloy, aluminum or aluminum alloy can be selected as a metal constituting the rear outer conductor 33 according to need. The rear outer conductor 33 includes a shield connecting portion 35 to be crimped to the braided wire 14 folded on the sleeve 27 from outside, a rear tube portion 36 connected in front of the shield connecting portion 35 for surrounding the outer peripheries of the coated wires 13 exposed from the braided wire 14, and a dielectric crimping portion 37 connected in front of the rear tube portion 36 and to be crimped to the dielectric 19 at a position near the rear end part of the dielectric 19 from outside.

The rear outer conductor 33 is crimped to the outer periphery of the braided wire 14 and crimped to the dielectric 19 at the position near the rear end part of the dielectric 19 from outside with both left and right side edges butted against each other. The dielectric crimping portion 37 is crimped to a part of the dielectric 19 behind the flange 28. A front end part of the dielectric crimping portion 37 comes into contact with the flange 28 from behind, whereby the rear outer conductor 33 and the dielectric 19 can be positioned in the front-rear direction.

An outer diameter of the shield connecting portion 35 is set to be larger than that of the dielectric crimping portion 37 with the rear outer conductor 33 crimped to the outer periphery of the braided wire 14 and crimped to the dielectric 19 at the position near the rear end part of the dielectric 19. The rear tube portion 36 located between the shield connecting portion 35 and the dielectric crimping portion 37 is formed into a shape reduced in diameter toward the front side.

The rear tube portion 36 is formed with projecting portions 40 projecting inward in a radial direction of the rear tube portion 36 from the inner wall of the rear tube portion 36 at a position corresponding to the coated wires 13 exposed forward from the braided wire 14. The projecting portions 40 are facing at least parts of the coated wires 13 exposed from the braided wire 14. The projecting portions 40 may be facing the entire parts of the coated wires 13 exposed from the braided wire 14.

Figure 8:
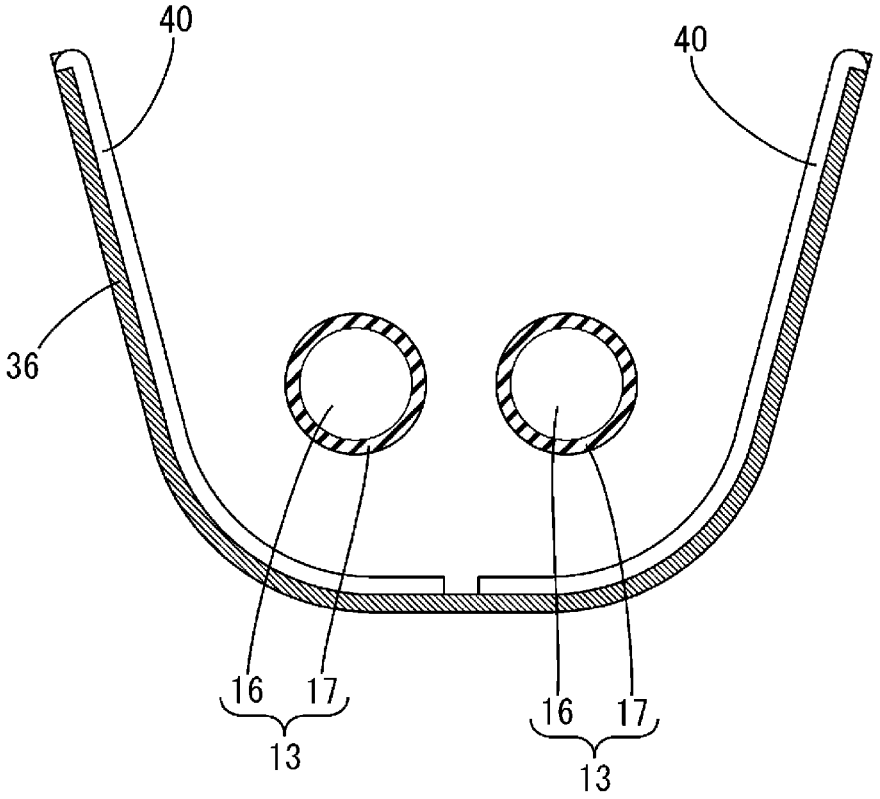
FIG. 8 is a section showing the step of crimping the rear outer conductor having the folded projecting portions to the braided wire and the dielectric.
Figure 9:
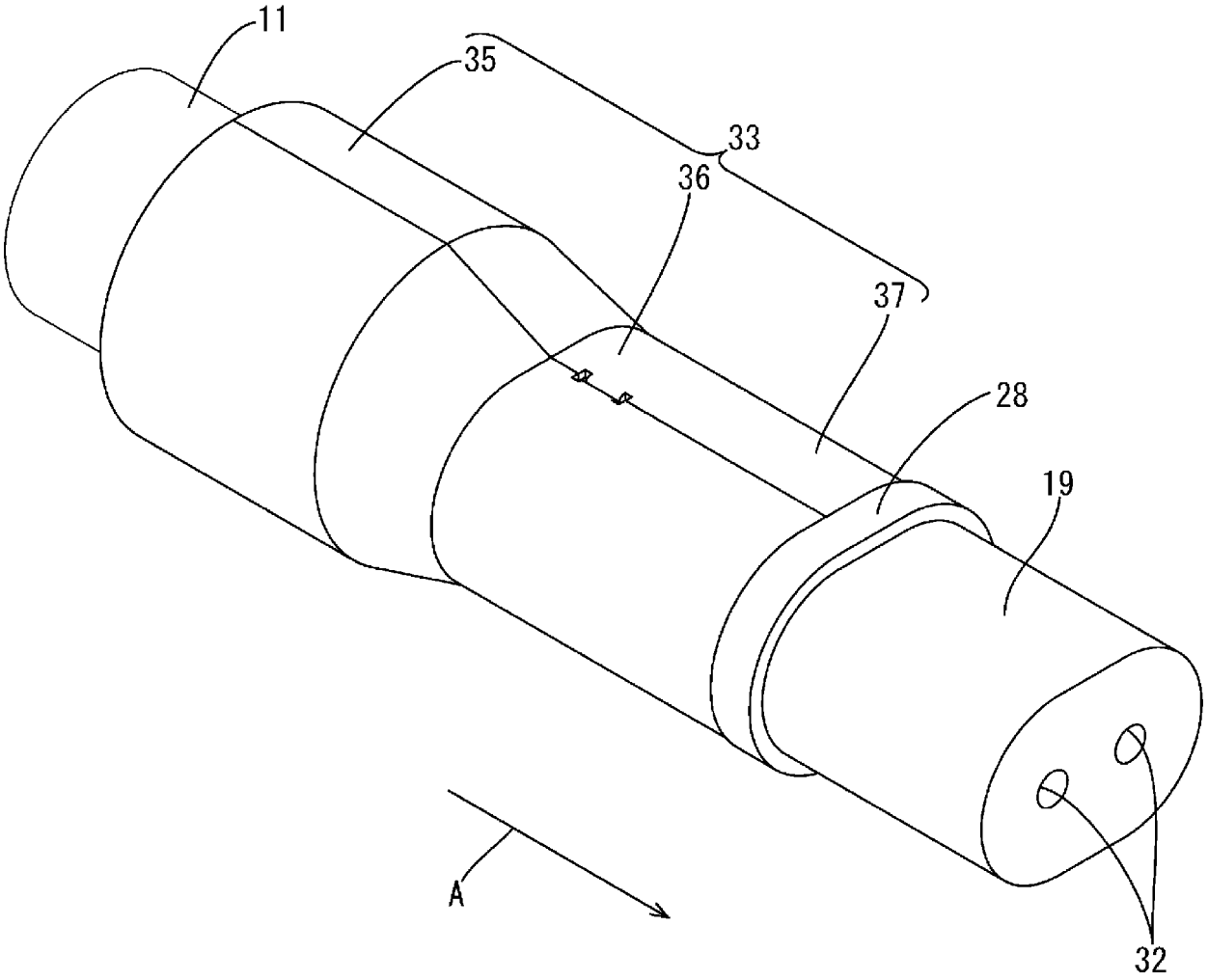
FIG. 9 is a perspective view showing a state where the rear outer conductor is crimped.
Figure 10:
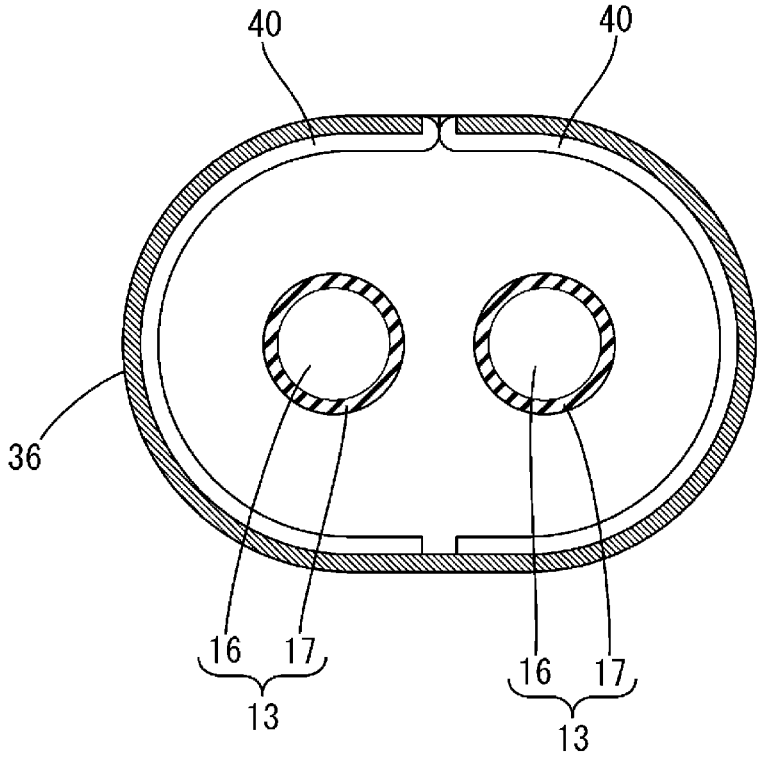
FIG. 10 is a section showing coated wires and the projecting portions.

As shown in FIGS. 7 and 8, the projecting portions 40 are formed by being folded along the inner surface of the rear tube portion 36 after projecting from both left and right side edges of the rear tube portion 36.

[Front Outer Conductor 34]

As shown in FIG. 1, the front outer conductor 34 is formed by press-working a metal plate material into a predetermined shape. An arbitrary metal such as copper, copper alloy, aluminum or aluminum alloy can be selected as a metal constituting the front outer conductor 34 according to need. The front outer conductor 34 includes a front tube portion 38 for surrounding the outer periphery of the dielectric 19 and a rear outer conductor crimping portion 39 connected behind the front tube portion 38 and to be crimped onto the dielectric crimping portion 37 crimped to a part of the dielectric 19 near the rear end part. A front end part of the front tube portion 38 is formed to extend further forward than the front end part of the dielectric 19. The rear outer conductor crimping portion 39 is crimped onto the dielectric crimping portion 37 of the rear outer conductor 33 behind the flange 28 of the dielectric 19. The rear outer conductor crimping portion 39 has a smaller diameter than the front tube portion 38.

[Manufacturing Process of Female Connector Structure 10]

Next, an example of a manufacturing process of the female connector structure 10 according to this embodiment is described. Note that the manufacturing process of the female connector structure 10 is not limited to the following one.

Figure 2:
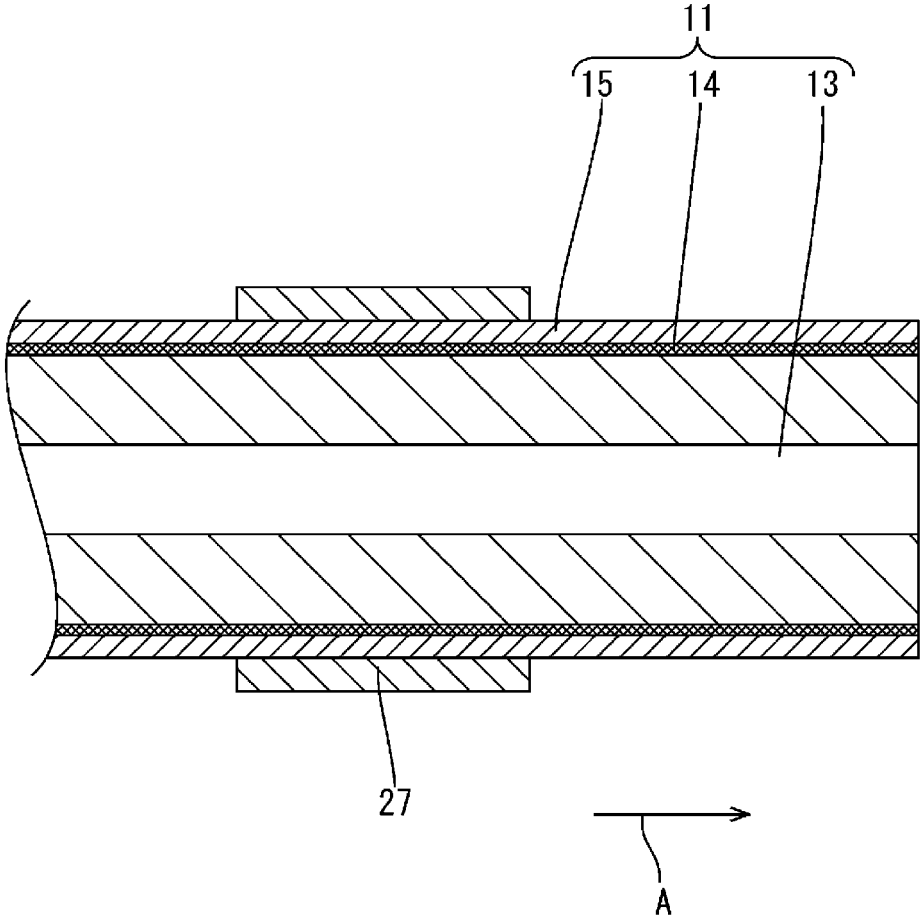
FIG. 2 is a section showing a step of externally fitting a sleeve to a shielded cable.
Figure 3:
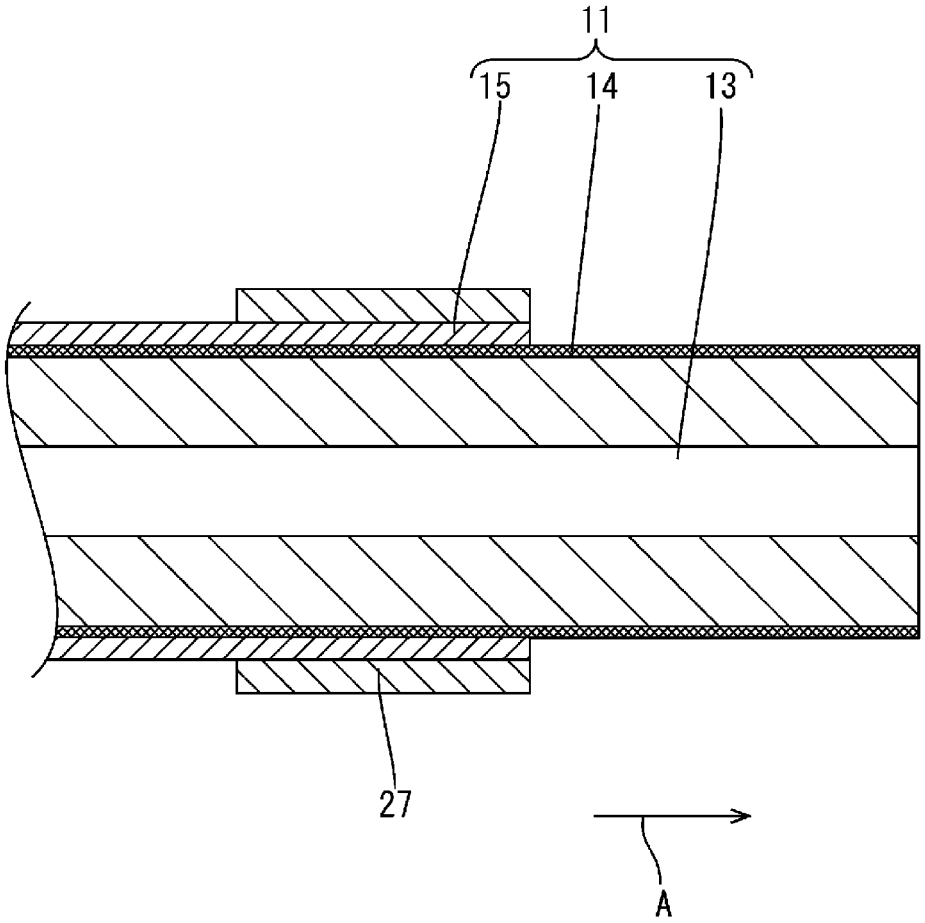
FIG. 3 is a section showing a step of stripping a sheath of the shielded cable.
Figure 4:
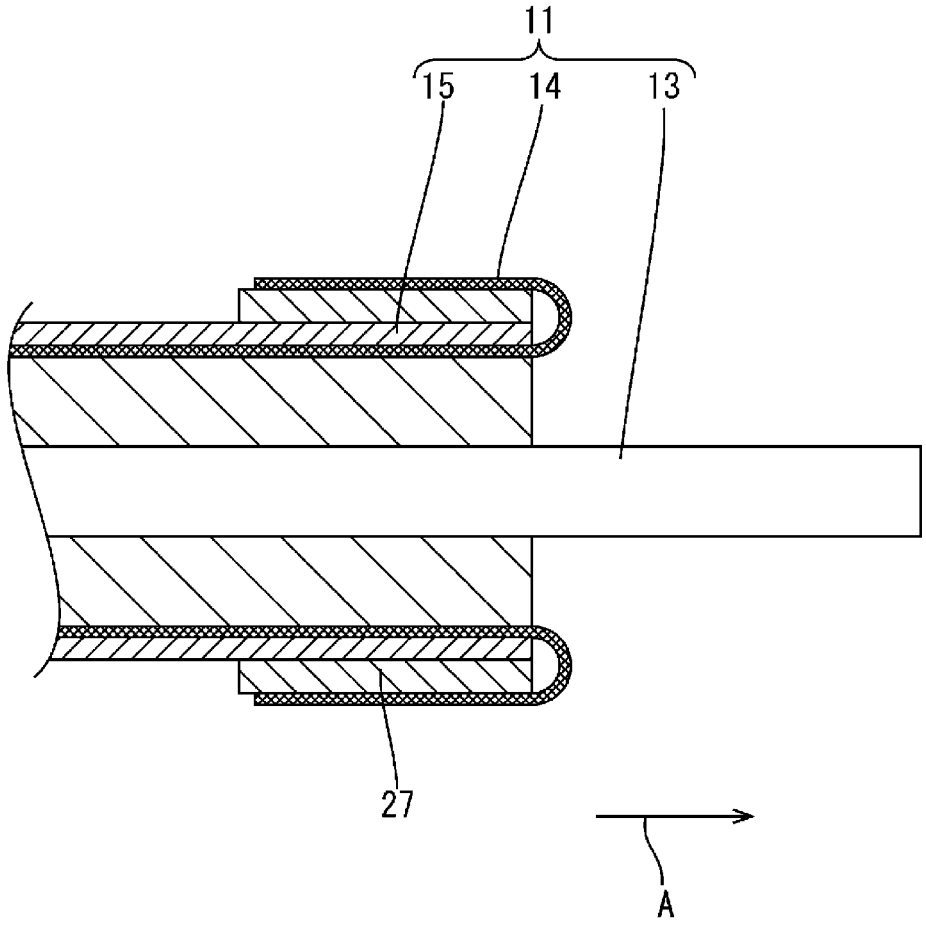
FIG. 4 is a section showing a step of folding a braided wire on the sleeve.

As shown in FIG. 2, the sleeve 27 is externally fit to the outer periphery of the sheath 15 at a position retracted from an end part of the shielded cable 11 by a predetermined length. As shown in FIG. 3, a part of the sheath 15 in front of a front end part of the sleeve 27 is stripped, thereby exposing the braided wire 14 from the sheath 15. The braided wire 14 is cut to a predetermined length to expose the coated wires 13 from the braided wire 14. The sleeve 27 serves as a mark of a position for the stripping of the sheath 15. As shown in FIG. 4, the braided wire 14 is folded rearward and overlapped on the sleeve 27. By stripping the insulation coatings 17 to a predetermined length on ends of the coated wires 13, the cores 16 are exposed from the insulation coatings 17.

As shown in FIG. 5, the female terminals 18 are inserted into the cavities 32 of the dielectric 19 from behind. As shown in FIG. 6, the wire barrel 22 of the female terminal 18 projects rearward from the rear end part of the dielectric 19. By crimping the wire barrel 22 to the outer periphery of the core 16 exposed from the front end part of the insulation coating 17, the female terminal 18 is connected to the end of the coated wire 13 (see FIG. 7).

As shown in FIGS. 7 and 8, the projecting portions 40 projecting from the both left and right side edges of the rear tube portion 36 provided in the rear outer conductor 33 are folded along the inner surface of the rear tube portion 36.

As shown in FIG. 7, the shield connecting portion 35 of the rear outer conductor 33 is crimped to the braided wire 14 folded on the sleeve 27 from outside. Further, the dielectric crimping portion 37 of the rear outer conductor 33 is crimped to the part of the dielectric 19 behind the flange 28 from outside.

A step of crimping the shield connecting portion 35 to the braided wire 14 and a step of crimping the dielectric crimping portion 37 to the dielectric 19 may be performed in the same step. Further, the step of crimping the shield connecting portion 35 to the braided wire 14 and the step of crimping the dielectric crimping portion 37 to the dielectric 19 may be separately performed. For example, the dielectric crimping portion 37 may be crimped to the dielectric 19 after the shield connecting portion 35 is first crimped to the braided wire 14 or the shield connecting portion 35 may be crimped to the braided wire 14 after the dielectric crimping portion 37 is first crimped to the dielectric 19.

The front outer conductor 34 is formed into a tubular shape. As shown in FIG. 1, the front outer conductor 34 formed into a tubular shape is assembled with the dielectric 19 from the front of the dielectric 19. The rear outer conductor crimping portion 39 of the front outer conductor 34 is crimped to the dielectric crimping portion 37 of the rear outer conductor 33 crimped to the dielectric 19 from outside. In the above way, the female connector structure 10 is completed (see FIG. 1).

[Functions and Effects of First Embodiment]

Next, functions and effects of this embodiment are described. According to this embodiment, the female connector structure 10 is provided with the shielded cable 11 configured such that the outer peripheries of the coated wires 13 each including the core 16 and the insulation coating 17 surrounding the outer periphery of the core 16 are surrounded by the braided wire 14, the female terminals 18 each including the wire barrel 22 to be connected to the core 16 and the connecting tube portion 23 continuous with the wire barrel 22 and to be connected to the mating terminal, the insulating dielectric 19 for surrounding at least the outer peripheries of the connecting tube portions 23 of the female terminals 18, and the outer conductor 20 for surrounding at least the coated wires 13 exposed from the braided wire 14, a part of the outer conductor 20 corresponding to the coated wires 13 exposed from the braided wire 14 being formed with the projecting portions 40 by causing a part of the inner surface of the outer conductor 20 to project from other parts radially inwardly of the outer conductor 40 and the outer surface of the outer conductor 20 being not depressed radially inwardly of the outer conductor 20.

According to the above configuration, the inner surface of the outer conductor 20 can be brought closer to the coated wires 13 without drawing the outer conductor 20. In this way, changes of characteristic impedances of the coated wires 13 can be suppressed without enlarging the outer conductor 20.

Further, according to this embodiment, the projecting portions 40 project from the end edges of the outer conductor 20 and are formed by being folded to overlap on the inner surface of the outer conductor 20.

According to the above configuration, since the inner surface of the outer conductor 20 can be brought closer to the coated wires 13 by a simple processing method of folding the projecting portions 40 projecting from the end edges of the outer conductor 20, the manufacturing cost of the female connector structure 10 can be reduced.

Further, according to this embodiment, the outer conductor 20 includes the rear outer conductor 33 having the shield connecting portion 35 to be crimped to the braided wire 14 from outside, the dielectric crimping portion 37 to be crimped to at least a part of the dielectric 19 from outside and the rear tube portion 36 for surrounding the coated wires 13 between the shield connecting portion 35 and the dielectric crimping portion 37, and the front outer conductor 34 having the front tube portion 38 for surrounding the dielectric 19 and the rear outer conductor crimping portion 39 to be crimped to the dielectric crimping portion 37 from outside, and the rear tube portion 36 is formed with the projecting portions 40.

According to the above configuration, since the rear and front outer conductors 33, 34 may not be welded, the rear and front outer conductors 33, 34 can be connected without being heated. As a result, the occurrence of troubles in the dielectric 19 due to heat can be suppressed.

Second Embodiment

Figure 11:
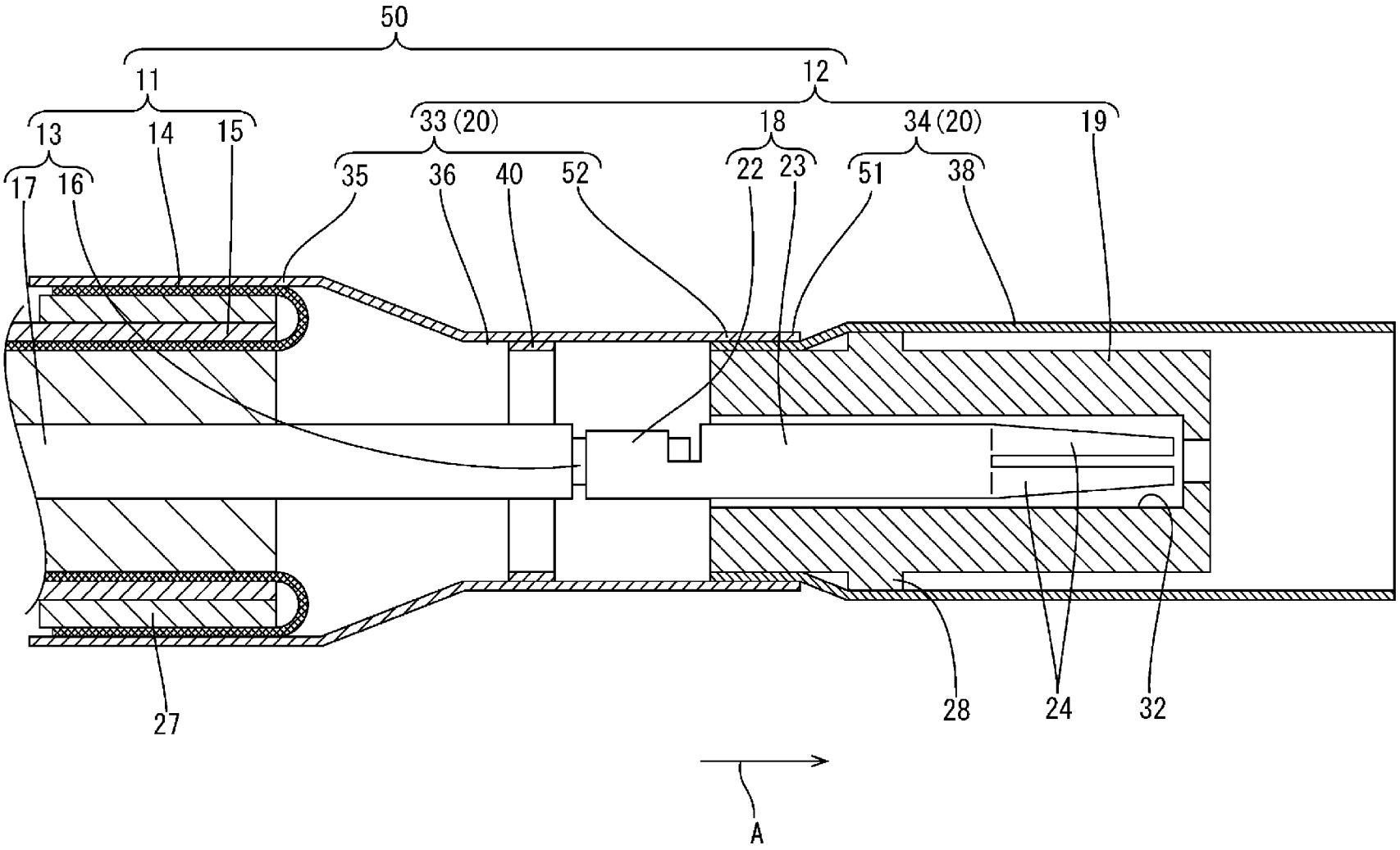
FIG. 11 is a section showing a female connector structure according to a second embodiment.

Next, a second embodiment in which the technique disclosed in this specification is applied to a female connector structure 50 is described with reference to FIG. 11. A front outer conductor 34 according to this embodiment includes a dielectric locking portion 51 connected behind a front tube portion 38 and having a smaller diameter than the front tube portion 38. An inner diameter of the front tube portion 38 is set to be equal to or somewhat larger than an outer diameter of a flange 28. A front end part of the front tube portion 38 is formed to extend further forward than a front end part of a dielectric 19. The inner wall surface of the dielectric locking portion 51 is locked to the flange 28 of the dielectric 19 and a part of the dielectric 19 behind the flange 28. In this way, the dielectric 19 inserted through a front opening of the front tube portion 38 is held in the front outer conductor 34 while being prevented from coming out rearward.

A rear outer conductor 33 according to this embodiment includes a front outer conductor crimping portion 52 connected in front of a rear tube portion 36 and to be crimped to the dielectric locking portion 51 locked at a position near a rear end part of the dielectric 19 from outside. The rear tube portion 36 is formed with projecting portions 40.

The rear outer conductor 33 is crimped to the outer periphery of the braided wire 14 and crimped to the dielectric locking portion 51 at the position near the rear end part of the dielectric locking portion 51 from outside with both left and right side edges butted against each other. The front outer conductor crimping portion 52 is crimped to the part of the dielectric 19 behind the flange 28 from outside. The front outer conductor crimping portion 52 is crimped to the dielectric locking portion 51 from outside, whereby the front outer conductor crimping portion 52 and the dielectric locking portion 51 are fixed to the dielectric 19 and the front and rear outer conductors 34, 33 are electrically connected.

An outer diameter of a shield connecting portion 35 is set to be larger than that of the front outer conductor crimping portion 52 with the rear outer conductor 33 crimped to the outer periphery of the braided wire 14 and crimped to the dielectric 19 at the position near the rear end part of the dielectric 19. A rear tube portion 36 located between the shield connecting portion 35 and the front outer conductor crimping portion 52 is formed into a shape reduced in diameter toward a front side.

Since the other configuration is substantially the same as in the first embodiment, the same members are denoted by the same reference signs and repeated description is omitted.

According to this embodiment, the outer conductor 20 includes the front outer conductor 34 having the front tube portion 38 for surrounding the dielectric 19 and the dielectric locking portion 51 to be locked to at least a part of the dielectric 19 and the rear outer conductor 33 having the shield connecting portion 35 to be crimped to the braided wire 14 from outside, the front outer conductor crimping portion 52 to be crimped to at least the dielectric locking portion 51 from outside and the rear tube portion 36 for surrounding the coated wires 13 between the shield connecting portion 35 and the front outer conductor crimping portion 52, and the rear tube portion 36 is formed with the projecting portions 40.

According to the above configuration, since the rear and front outer conductors 33, 34 may not be welded, the rear and front outer conductors 33, 34 can be connected without being heated. As a result, the occurrence of troubles in the dielectric 19 due to heat can be suppressed.

Third Embodiment

Figure 12:
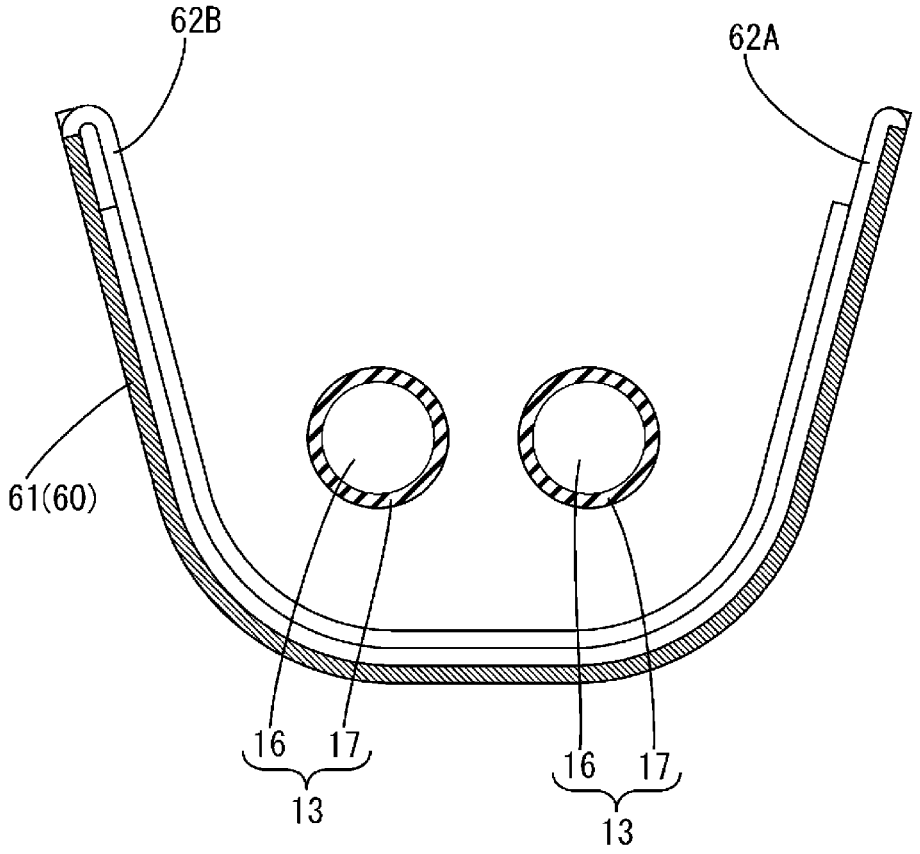
FIG. 12 is a section showing projecting portions according to a third embodiment.
Figure 13:
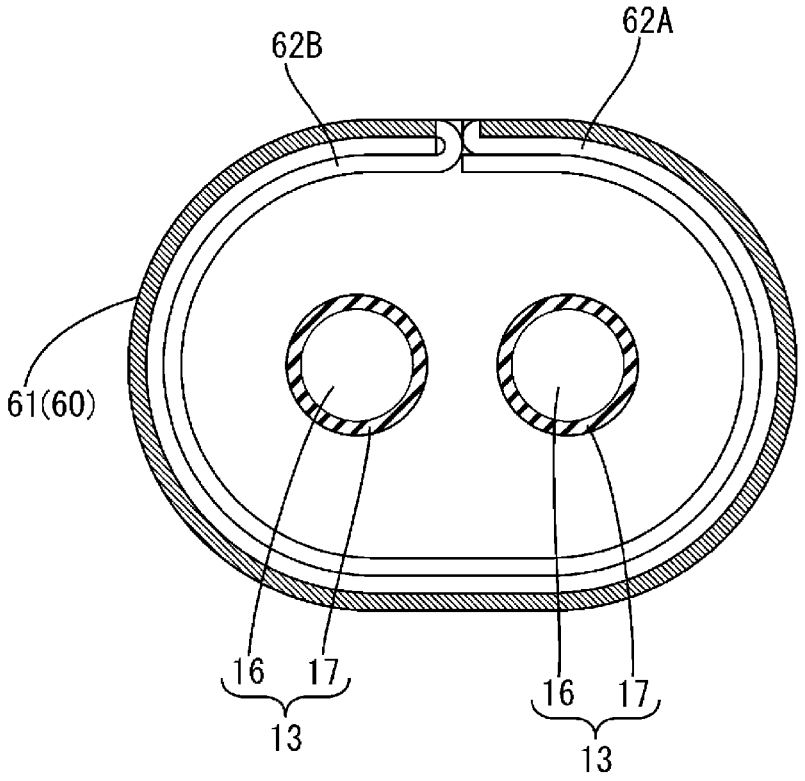
FIG. 13 is a section showing coated wires and the projecting portions.

Next, a third embodiment of the technique disclosed in this specification is described with reference to FIGS. 12 and 13. In a rear tube portion 61 of a rear outer conductor 60 according to this embodiment, a projecting portion 62A projecting from one of both left and right side edges of the rear tube portion 61 is folded along the inner wall surface of the rear tube portion 61. Further, a projecting portion 62B projecting from the other of the both left and right side edges of the rear tube portion 61 is folded to overlap on the projecting portion 62A. In this way, an inward projection dimension of the projecting portions 62A, 62B from the rear tube portion 61 is twice the thickness of the rear tube portion 61. Since the inner surface of the rear tube portion 61 can be brought closer to coated wires 13 in this way, changes of characteristic impedances of the coated wires 13 can be suppressed.

Other Embodiments

The technique disclosed in this specification is not limited to the above described and illustrated embodiments. For example, the following embodiments are also included in the technical scope of the technique disclosed in this specification.

(1) The shielded cable may include three or more coated wires.

(2) An arbitrary material such as a metal foil or a resin tape having a metal foil adhered thereto can be appropriately selected for a shield layer without being limited to the braided wire 14.

(3) The sheath may be omitted.

(4) The braided wire 14 exposed by stripping the sheath may not be folded on the end of the sheath.

(5) The braided wire 14 and the shield connecting portion 35 may be electrically connected by crimping a crimping member formed separately from the rear outer conductor 33 to the shield connecting portion from outside the shield connecting portion with the shield connecting portion 35 externally fit to the outer periphery of the braided wire 14.

(6) The connector structure may be a male connector structure including male terminal(s).

(7) The projecting portion may be formed by causing only a part of the metal plate material constituting the rear outer conductor to project radially inwardly.

(8) Although the projecting portions 62A, 62B overlap in the second embodiment, there is no limitation to this and three or more projecting portions may overlap.

LIST OF REFERENCE NUMERALS

10, 50: female connector structure (example of connector structure)
11: shielded cable
12: female connector
13: coated wire
14: braided wire (example of shield portion)
15: sheath
16: core
17: insulation coating
18: female terminal (example of inner conductor)
19: dielectric
20: outer conductor
22: wire barrel (example of core connecting portion)
23: connecting tube portion (example of connecting portion)
24: resilient contact piece
27: sleeve
28: flange
32: cavity
33, 60: rear outer conductor
34: front outer conductor
35: shield connecting portion
36, 61: rear tube portion
37: dielectric crimping portion
38: front tube portion
39: rear outer conductor crimping portion
40, 62A, 62B: projecting portion
51: dielectric locking portion
52: front outer conductor crimping portion

What is claimed is:

1. A connector structure, comprising:

a shielded cable including:

a coated wire including a core and an insulation coating configured to surround an outer periphery of the core; and a shield portion configured to surround an outer periphery of the coated wire;

an inner conductor including a core connecting portion connected to the core and a connecting portion continuous with the core connecting portion and connected to a mating terminal;

an insulating dielectric configured to surround at least an outer periphery of the connecting portion of the inner conductor; and an outer conductor including a shield connecting portion electrically connected to the shield portion, the outer conductor surrounding at least the coated wire exposed from the shield portion, wherein a part of the outer conductor corresponding to the coated wire exposed from the shield portion is formed with a projecting portion by causing a part of an inner surface of the outer conductor to project from other parts radially inwardly of the outer conductor such that the inner surface of the outer conductor becomes closer to the coated wire by a thickness of the projecting portion, the projecting portion being provided at a position corresponding to the coated wire exposed from the shield portion in a longitudinal direction of the outer conductor, and an outer surface of the outer conductor is not depressed radially inwardly of the outer conductor.

2. The connector structure of claim 1, wherein the projecting portion projects from an end edge of the outer conductor and is folded to overlap on the inner surface of the outer conductor.

3. The connector structure of claim 1, wherein:

the outer conductor includes:

a rear outer conductor having a shield connecting portion crimped to the shield portion from outside, a dielectric crimping portion crimped to at least a part of the dielectric from outside and a rear tube portion configured to surround the coated wire between the shield connecting portion and the dielectric crimping portion; and a front outer conductor having a front tube portion configured to surround the insulating dielectric and a rear outer conductor crimping portion crimped to the dielectric crimping portion from outside, and the rear tube portion is formed with the projecting portion.

4. The connector structure of claim 1, wherein:

the outer conductor includes:

a front outer conductor having a front tube portion configured to surround the dielectric and a dielectric locking portion to be locked to at least a part of the dielectric; and a rear outer conductor having a shield connecting portion crimped to the shield portion from outside, a front outer conductor crimping portion crimped to at least the dielectric locking portion from outside, and a rear tube portion configured to surround the coated wire between the shield connecting portion and the front outer conductor crimping portion, and the rear tube portion is formed with the projecting portion.

5. The connector structure of claim 1, wherein the projecting portion is provided between the shield portion of the shielded cable and the core connecting portion of the inner conductor in a longitudinal direction of the outer conductor.

6. The connector structure of claim 1, wherein the shield portion is formed by braiding a plurality of metal wires into a tubular shape.

* * * * *